US007491030B1

(12) United States Patent
Pinera et al.

(10) Patent No.: US 7,491,030 B1
(45) Date of Patent: Feb. 17, 2009

(54) MAGNETICALLY ACTUATED GUIDE VANE

(75) Inventors: Alex Pinera, Jupiter, FL (US); Gabriel L Johnson, Port St. Lucie, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 388 days.

(21) Appl. No.: 11/510,142

(22) Filed: Aug. 25, 2006

(51) Int. Cl.
*F01D 9/02* (2006.01)

(52) U.S. Cl. ..... 415/161; 415/209.4; 415/210.1; 415/191

(58) Field of Classification Search ..... 415/161, 415/163, 164, 165, 191, 209.4, 210.1; 416/3, 416/229 R
See application file for complete search history.

(56) References Cited

U.S. PATENT DOCUMENTS

| | | | | |
|---|---|---|---|---|
| 3,237,918 | A | 3/1966 | Le Bell et al. | |
| 3,295,827 | A | 1/1967 | Chapman et al. | |
| 4,029,433 | A | 6/1977 | Penny et al. | |
| 4,648,345 | A * | 3/1987 | Wham et al. | 114/338 |
| 4,705,452 | A | 11/1987 | Karadimas | |
| 4,741,665 | A | 5/1988 | Hanser | |
| 4,897,020 | A | 1/1990 | Tonks | |
| 4,995,786 | A | 2/1991 | Wheeler et al. | |
| 5,215,434 | A | 6/1993 | Greune et al. | |
| 5,314,301 | A | 5/1994 | Knight | |
| 5,472,314 | A | 12/1995 | Dlonge et al. | |
| 6,994,518 | B2 | 2/2006 | Simon et al. | |
| 7,048,506 | B2 * | 5/2006 | Atmur et al. | 416/30 |

* cited by examiner

*Primary Examiner*—Ninh H Nguyen
(74) *Attorney, Agent, or Firm*—John Ryznic

(57) ABSTRACT

A variable inlet guide vane assembly in a turbomachine in which the vanes can vary in angle to control the flow through into the turbomachine, each guide vane having a leading edge portion and a trailing edge portion, and where the entire vane can pivot or the trailing edge portion can pivot about the leading edge portion. The leading edge and trailing edge portions each have a magnetic field generating material located within the portion of the vane or one a surface of the vane. The vanes are offset in the shroud such that the trailing edge portion of a first vane is located closer to the leading edge portion of an adjacent vane than to the trailing edge portion of the adjacent vane. An electric current is passed through at least one of the trailing edge and leading edge portions to produce a magnetic field. The magnetic field causes the trailing edge portion to move toward the leading edge portion of the adjacent vane.

18 Claims, 2 Drawing Sheets

MAGNETICALLY ACTUATED GUIDE VANE

BACKGROUND OF THE INVENTION

1. Field of the Invention

The present invention relates generally to fluid reaction surfaces, and more specifically to variable guide vanes in a turbomachine.

2. Description of the Related Art Including Information Disclosed Under 37 CFR 1.97 and 1.98

In a turbomachine such as a gas turbine engine, a compressor includes multiple stages of rotor blades to progressively compress air for use in the combustor to produce a hot gas flow that passes through a turbine to extract mechanical power. A turbofan engine includes a large fan assembly connected to the rotor and located in front of the first compressor blade. Turbofan engines are required to operate efficiently over a wide range of flight conditions and speeds. These conditions include maximum power takeoff and climb, part-power cruise, and low-altitude, low-power loiter. In order to meet these requirements of variable thrust while maintaining an acceptable level of specific fuel consumption, it is common to selectively vary certain flow areas and characteristics within the fan and core portion of the engine. One of the flows which may be varied is that in the fan duct, and this may be accomplished by use of variable inlet guide vanes (IGV's) which are selectively varied over a range to modulate the total airflow in the duct.

Large turbofan engines include variable inlet guide vanes having a complex mechanical connection and include seals, bushing, actuators and other mechanism to control the position of the guide vanes. These are very complex and costly, especially for use in small gas turbine engines.

An example of a complex inlet guide vane apparatus is shown in U.S. Pat. No. 5,215,434 issued to Greune et al on Jun. 1, 1993 entitled APPARATUS FOR THE ADJUSTMENT OF STATOR BLADES OF A GAS TURBINE. For a small turbofan engine, use of the arrangement would add a high cost to a rather low priced engine.

Guide vanes include a leading edge portion and a trailing edge portion. Some variable inlet guide vanes provide a fixed leading edge portion while the trailing edge portion pivots with respect to the leading edge portion. U.S. Pat. No. 4,741,665 issued to Hanser on May 3, 1988 entitled GUIDE VANE RING FOR TURBO-ENGINES, ESPECIALLY GAS TURBINES shows one of these.

Some inlet guide vanes include a fixed middle portion with the leading edge and trailing edge portions variable with respect to the fixed middle portion such that the entire length of the vane chord is variable. U.S. Pat. No. 3,295,827 issued to Chapman et al on Jan. 3, 1967 entitled VARIABLE CONFIGURATION BLADE shows this configuration. This type is also a complex arrangement and therefore would be costly for a small turbofan engine.

U.S. Pat. No. 4,029,433 issued to Penny et al on Jun. 14, 1977 entitled STATOR VANE ASSEMBLY shows a simple variable vane mechanism in which vanes are supported on a fixed wall at one end and on a movable sleeve on the other end, where the movable sleeve is displaced in an axial direction to vary the angle of the vanes. This arrangement is less complex than the others, yet it still includes an actuator and linkage to provide pivot movement of the vane.

BRIEF SUMMARY OF THE INVENTION

The present invention is a variable inlet guide vane arrangement for use in a turbomachine, in which the vanes include magnetic materials and a current is provided to increase a magnetic attraction between adjacent vane portions such that a positive magnetic force occurring on the leading edge of one vane will attract a negative magnetic force occurring on the trailing edge of an adjacent vane and move the trailing edge portion to vary the vane angle. A variable inlet guide vane arrangement is thus possible without the use of mechanical linkages to cause the vanes to vary in angle. The movement generating means is a simple current generating device.

DETAILED DESCRIPTION OF THE INVENTION

Figure 1:
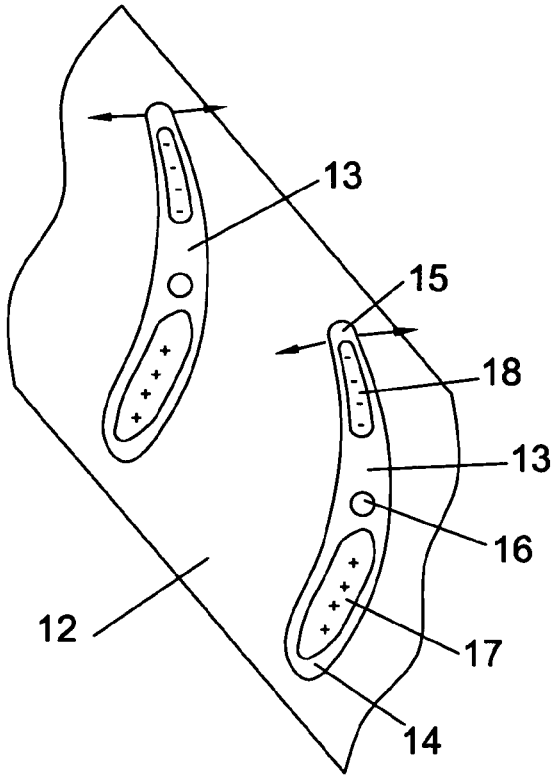
FIG. 1 shows a cross section view of two adjacent variable inlet guide vanes having magnetic materials located within the vane body.

The variable inlet guide vane arrangement of the present invention is shown in FIG. 1 from a view looking straight down the axis of the vanes. A shroud 12 includes a plurality of vanes 13 in a circumferential arrangement. Each vane 13 includes a leading edge portion 14 and a trailing edge portion 15. A center portion of the vane includes a pin 16 extending through the vane and supports the vane 13 for pivoting with respect to the shroud 12. In this embodiment, each vane 13 is capable of pivoting about the pin 16. The leading edge portion 14 includes a cavity in which a magnetic producing material 17 is embedded, while the trailing edge portion 15 includes a cavity in which a magnetic producing material 18 is embedded. Adjacent vanes have the same structure. The magnetic producing materials in the two portions are of different polarity in that one of these—for example the leading edge—will have a positive polarity while the other—for example the trailing edge—will have a negative polarity. This is so that the trailing edge portion of one vane will be attracted to the leading edge portion of the adjacent vane when the magnetic polarity is high enough. Because of the arrangement of the vane around the shroud and the curvature or angular offset of the vanes, the trailing edge of one vane is located closer to the leading edge portion of an adjacent vane. FIG. 1 shows this arrangement.

The magnetic producing materials can be of the type in which an electric current is passed through to produce a positive or negative polarity. Or, one of the magnetic materials—for example, the leading edge material 17 can be a permanent magnet—while the trailing edge material 18 can be a non-magnet that can be negatively magnetized by passing a current through it. Using permanent magnets in the leading edge cavity will not cause the adjacent vanes to move about the pin 16 unless the trailing edge material 18 is magnetized to cause attraction.

Figure 2:
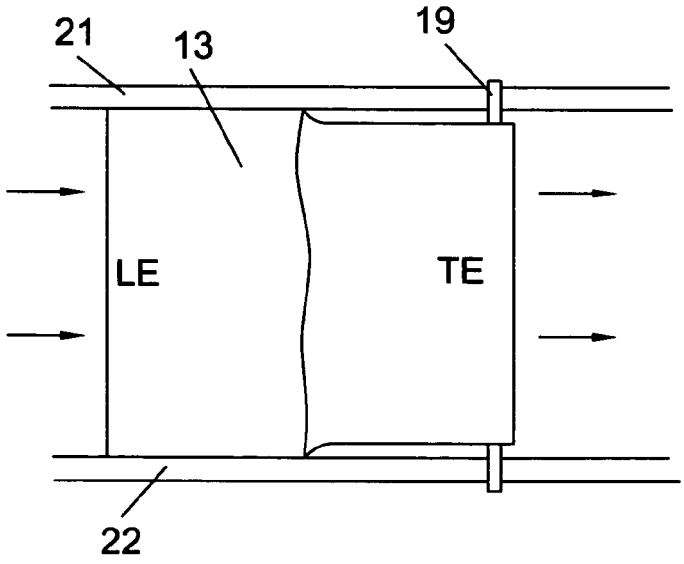
FIG. 2 shows a side view of a variable inlet guide vane positioned between an inner shroud and an outer shroud.
Figure 3:
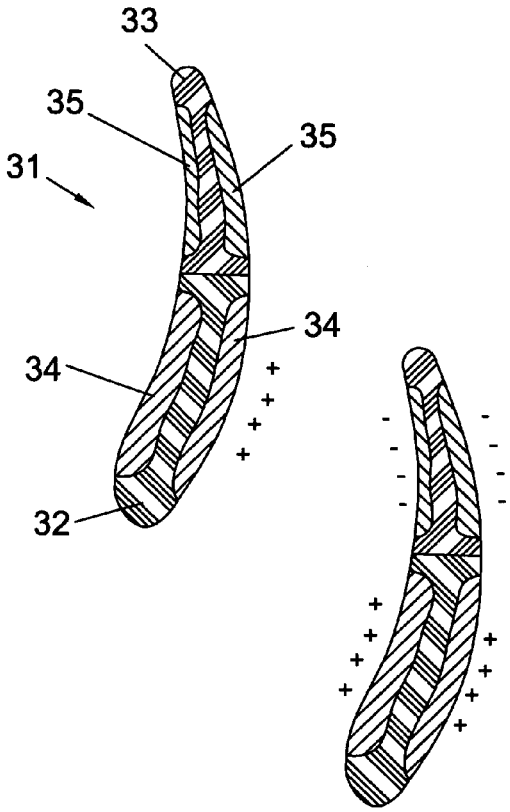
FIG. 3 shows a second embodiment of the variable inlet guide vanes having magnetic materials located on the surface of the vane.

FIG. 2 shows a second embodiment of the present invention from a side view. In this embodiment, the leading edge portion of the vane is fixed between the outer shroud 21 and the inner shroud while the trailing edge portion pivots about the fixed portion of the vane 13. a pin 19 extends from the trailing edge portion and is used to limit and fix the pivoting movement of the trailing edge. FIG. 3 shows a top view of this embodiment in which the leading edge portion 32 is made of one material and fixed to the shrouds, while the trailing edge portion 33 is made of a second material that can flex with respect to the leading edge material. This embodiment eliminates pivoting mechanism required between the two portions of the vane to allow for a change in angle. In the FIG. 3 embodiment, the magnetic producing materials are secured in cavities open to the outside of the airfoil such that the outer surface of the materials 34 and 35 forms the airfoil surface. The magnetic producing materials are located on both sides of the vane as shown in FIG. 3. The leading edge 34 and trailing edge 35 magnetic producing materials can be both oppositely polarized by passing a current through them, or the leading edge material 24 could be a permanent magnetic while the trailing edge material 35 could be magnetized by passing a current.

Figure 4:
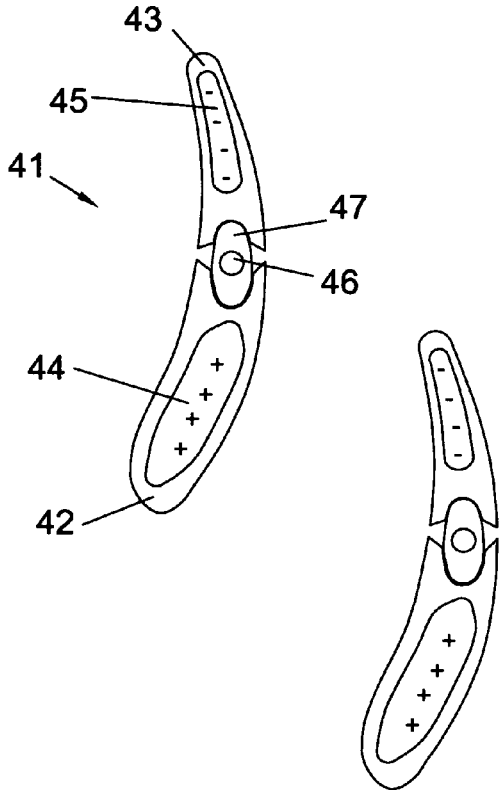
FIG. 4 shows another embodiment of the present invention in which the variable vanes pivot about a non-metallic sleeve.

FIG. 4 shows a third embodiment of the vane in FIG. 2. The leading edge portion 42 pivots about the trailing edge portion 43 through a non-metallic sleeve 47 having a hole 46 therein. In the FIG. 4 embodiment, the magnetic producing materials are located within cavities of the vane as in the FIG. 1 embodiment. The sleeve 47 can be oblong as shown in FIG. 4, or can be a circular tube like is some prior art pivoting vanes. The pivoting of the vanes in the FIG. 4 embodiment is performed by the same process as in the earlier embodiments. A magnetic attraction is developed between the leading edge of one vane and the trailing edge of an adjacent vane to cause the trailing edge to leading edge spacing to decrease.

A simple and inexpensive variable inlet guide vane arrangement is thus possible with the embodiments of the present invention. No complex and expensive mechanical linkages are required to produce movement of the vanes. Only a current is required to provide movement of the vanes to change the angle and effect engine operations. No parts are used that could break, wear out, or become lose during operation or storage of the engine. The electric current required for magnetizing the materials could be taken off from the generator of the engine instead of using a separate electric power source.

FIG. 2 shows the vane having a fixed leading edge with a flexible trailing edge with the pin 19 extending in a shroud slot to limit the movement. In another embodiment, the trailing edge could be fixed while the leading edge could be flexible with the pin 19 extending into a slot of the shroud to limit movement of the leading edge. This would be a mirror image of FIG. 2.

We claim:

1. A variable inlet guide vane assembly for use in a turbomachine, the vane assembly directing a flow into the rotor blades of the turbomachine, the variable guide vane assembly comprising:

A shroud forming a flow path into the guide vanes;

A plurality of variable guide vanes extending from the shroud and into the flow path;

A first magnet means to produce a magnetic field attached to a first vane;

A second magnetic means to produce a magnetic field attached to a second vane positioned adjacent to the first vane; and, Means to produce a magnetic field between the two magnet means to vary the guide vanes.

2. The variable inlet guide vane assembly of claim 1, and further comprising:

The means to produce a magnetic field between the two magnet means is passing an electric current through two magnets located on the adjacent vanes.

3. The variable inlet guide vane assembly of claim 1, and further comprising:

The first magnetic means is located on a trailing edge portion of the first vane; and, The second magnetic means is located on a leading edge portion of the second vane.

4. The variable inlet guide vane assembly of claim 3, and further comprising:

The first and second magnetic means produces an opposite polarity that attracts the magnetic means.

5. The variable inlet guide vane assembly of claim 1, and further comprising:

The first magnetic field producing member is located within the trailing edge portion of the first vane; and, The second magnetic field producing member is located within the leading edge portion of the second vane.

6. The variable inlet guide vane assembly of claim 1, and further comprising:

The first magnetic field producing member is located on a surface of the trailing edge portion of the first vane; and, The second magnetic field producing member is located on a surface of the leading edge portion of the second vane.

7. The variable inlet guide vane assembly of claim 1, and further comprising:

The vanes include a pivot pin located between the leading edge and the trailing edge to allow for the vanes to pivot.

8. The variable inlet guide vane assembly of claim 1, and further comprising:

The leading edge portion of the vanes is formed of a substantially stiff material; and, The trailing edge portion of the vanes is formed of a substantially flexible material.

9. The variable inlet guide vane assembly of claim 1, and further comprising:

The leading edge portion is attached to the trailing edge portion by a means to allow for pivoting between members.

10. The variable inlet guide vane assembly of claim 1, and further comprising:

The first magnetic field producing member secured to the first vane is a non-magnetic material that requires an electric current to produce a magnetic field; and, The second magnetic field producing member secured to the second vane is a permanent magnet.

11. The variable inlet guide vane assembly of claim 1, and further comprising:

The leading edge portions of the vanes are fixed; and,

The trailing edge portions are pivotally connected to the leading edge portions.

12. The variable inlet guide vane assembly of claim 1, and further comprising:

The adjacent vanes are offset such that the trailing edge portion of the first vane is located closer to the leading edge portion of the second vane that to the trailing edge portion of the second vane.

13. A variable inlet guide vane assembly for use in a turbomachine, the vane assembly directing a flow into the rotor blades of the turbomachine, the variable guide vane assembly comprising:

A shroud forming a flow path into the turbomachine;

A first vane extending from the shroud;

A second vane extending from the shroud and located adjacent to the first vane;

A first magnetic field producing member secured to the first vane;

A second magnetic field producing member secured to the second vane; and,

Means to provide an electric current in the first and second magnetic field producing members to provide a magnetic attraction between the two magnetic field producing members.

14. A process for changing an angle for vanes in an adjustable inlet guide vane assembly located upstream of a turbomachine, the inlet guide vanes each having a leading edge portion and a trailing edge portion, the process comprising the steps of:

Securing a first means to generate a magnetic field on a trailing edge portion of a first vane;

Securing a second means to generate a magnetic field on a leading edge portion of a second vane adjacent to the first vane; and, Passing a current through at least one of the first and second means to generate a magnetic field to cause the trailing edge portion of the first vane to move toward the leading edge portion of the second vane.

15. The process for changing an angle for vanes of claim 14, and further comprising the step of:

Fixing the leading edge portion of the vanes while allowing the trailing edge portion of the vanes to flex with respect to the leading edge portion.

16. The process for changing an angle for vanes of claim 14, and further comprising the step of:

Pivotally supporting each vane by a pin.

17. The process for changing an angle for vanes of claim 14, and further comprising the step of:

Pivotally supporting each vane by a non-metallic sleeve fixed to a shroud positioned between the leading edge portion and the trailing edge portion of each vane.

18. The process for changing an angle for vanes of claim 14, and further comprising the steps of:

Providing for a permanent magnet on one of the leading edge portions and the trailing edge portions;

Providing for a non-permanent magnet on the other of the leading edge portions and the trailing edge portions; and, Passing a current through the non-permanent magnet to produce a magnetic field.

* * * * *